US006199482B1

(12) United States Patent
Yasoshima

(10) Patent No.: US 6,199,482 B1
(45) Date of Patent: Mar. 13, 2001

(54) STAMP PAD WITH ROTARY LID AND ARTICULATED HINGE

(75) Inventor: Rira Yasoshima, Tokyo (JP)

(73) Assignee: Tsukineko, Inc., Redmond, WA (US)

( * ) Notice: Subject to any disclaimer, the term of this patent is extended or adjusted under 35 U.S.C. 154(b) by 0 days.

(21) Appl. No.: 09/387,305

(22) Filed: Aug. 31, 1999

(30) Foreign Application Priority Data

Jun. 25, 1999 (JP) ..... 11-180637

(51) Int. Cl.[7] ..... B05C 21/00; B41K 1/54

(52) U.S. Cl. ..... 101/333; 101/108; 118/264; D18/17; D18/18

(58) Field of Search ..... 101/327, 333, 101/368, 405, 103, 101, 108, 97, 98; 118/264, 265, 269, 270, 46; 434/84; D18/15, 16, 17, 18

(56) References Cited

U.S. PATENT DOCUMENTS

| | | | |
|---|---|---|---|
| D. 184,720 | 3/1959 | Fleming | D58/12 |
| D. 247,063 | 1/1978 | Funahashi | D64/10 |
| D. 252,935 | 9/1979 | Henkels | D19/77 |
| D. 331,418 | 12/1992 | Winston | D18/15 |
| D. 345,826 | 4/1994 | Byars et al. | D28/83 |
| D. 347,089 | 5/1994 | Byars et al. | D28/83 |
| D. 353,392 | 12/1994 | Winston | D18/15 |
| D. 363,303 | 10/1995 | Winston | D18/18 |
| D. 367,291 | 2/1996 | Winston | D18/17 |
| D. 372,731 | 8/1996 | Yasoshima | D18/17 |
| D. 372,933 | 8/1996 | Winston | D18/17 |
| D. 375,516 | 11/1996 | Winston | D18/17 |
| D. 381,038 | 7/1997 | Yasoshima | D18/17 |
| D. 381,357 | 7/1997 | Yasoshima | D18/17 |
| D. 382,581 | 8/1997 | Yasoshima | D18/17 |
| D. 386,200 | 11/1997 | Winston | D18/17 |
| D. 389,174 | 1/1998 | Yasoshima | D18/17 |
| D. 389,509 | 1/1998 | Yasoshima | D18/17 |
| D. 400,567 | 11/1998 | Yasoshima | D18/17 |
| D. 419,180 | 1/2000 | Yasoshima | D18/17 |
| D. 428,434 * | 7/2000 | Yasoshima | D18/17 |
| 602,061 | 4/1898 | Echelberger | 118/264 |
| 657,961 | 9/1900 | Roberts | 118/269 |
| 848,063 | 3/1907 | Sommer | 118/264 |
| 1,173,092 | 2/1916 | Bickerton | 118/71 |

(List continued on next page.)

FOREIGN PATENT DOCUMENTS

| | | | |
|---|---|---|---|
| 546609 | 9/1957 | (CA) . | |
| 662905 | 6/1938 | (DE) . | |
| 167 380 A2 | 1/1996 | (EP) . | |
| 2675740 A1 | 10/1992 | (FR) . | |
| 4940 | of 1896 | (GB) . | |
| 242197 * | 11/1925 | (GB) | 101/333 |
| 2045687 | 11/1980 | (GB) . | |
| 4-312881 | 11/1992 | (JP) . | |

OTHER PUBLICATIONS

Clearsnap, Inc., "Art Supplies for Rubber Stamps" Catalog, pp. 23–26, 1990.
Tsukineko, "Color Palette" Pigment Stamp Pad Catalog (Japanese), 4 pages.
Tsukineko, Japanese Catalog, 6 pages, 1993.

(List continued on next page.)

*Primary Examiner*—John S. Hilten
*Assistant Examiner*—Leslie J. Grohusky
(74) *Attorney, Agent, or Firm*—SEED IP Law Group PLLC

(57) ABSTRACT

A stamp pad having a hinge plate between a body and a lid of the stamp pad. The hinge plate allows the lid to be rotated underneath the body of the stamp pad when the lid is in an open position. The hinge plate can be made of a flexible material to make installation of the lid easier and to reduce the likelihood of damaging the lid or the body after the hinge plate is installed.

10 Claims, 10 Drawing Sheets

U.S. PATENT DOCUMENTS

| | | | | |
|---|---|---|---|---|
| 1,463,718 | | 7/1923 | Munson | 101/202 |
| 1,598,538 | | 8/1926 | Mann | 118/264 |
| 1,796,137 | | 3/1931 | Baumgarten | 118/255 |
| 2,117,470 | | 5/1938 | Zareko | 91/54.5 |
| 2,290,488 | | 7/1942 | Munson | 91/54.5 |
| 2,374,198 | | 4/1945 | Harris | 91/54.5 |
| 2,422,814 | | 6/1947 | Alexander | 91/54.5 |
| 2,723,476 | | 11/1955 | Lyon | 41/1 |
| 3,311,227 | * | 3/1967 | David et al. | 101/333 |
| 3,326,180 | | 6/1967 | Lofgren | 118/264 |
| 3,590,734 | | 7/1971 | Carter | 101/333 |
| 3,797,390 | | 3/1974 | Marozzi et al. | 101/333 |
| 3,855,925 | | 12/1974 | Funahashi | 101/333 |
| 4,029,011 | | 6/1977 | Kurner | 101/330 |
| 4,145,967 | | 3/1979 | Marozzi | 101/333 |
| 4,579,057 | * | 4/1986 | Hewitt et al. | 101/379 |
| 4,986,175 | | 1/1991 | Boehringer et al. | 101/125 |
| 4,996,921 | | 3/1991 | Hong | 101/333 |
| 5,431,098 | | 7/1995 | Winston | 101/211 |
| 5,462,595 | | 10/1995 | Im | 118/264 |
| 5,505,130 | | 4/1996 | Winston | 101/333 |
| 5,531,829 | | 7/1996 | Yasoshima | 118/264 |
| 5,601,644 | | 2/1997 | Yasoshima | 118/46 |
| 5,636,569 | | 6/1997 | Winston | 101/333 |
| 5,653,804 | | 8/1997 | Yasoshima | 118/46 |
| 5,865,305 | | 2/1999 | Yasoshima | 206/1.7 |
| 5,865,892 | | 2/1999 | Yasoshima | 118/264 |

OTHER PUBLICATIONS

Clearsnap, Inc., "Color Box Pigment Stamp Pads" (See circled stamp pad, top left), 1 page, 1993.

Clearsnap, Inc., "Define: Colorbox," 1 page, 1995.

Tsukineko, "The Possibilities Are Endless" Catalog, 6 pages, May 1995.

Tsukineko, "Rubber Stamp/Ink Pad" 1996/97 Catalog, pp. 1–8.

Stencil & Hobby Catalog (Japanese), 3 pages, 1999.

Ink–A–Dink–A–Do, "4 Inks in One" Stamp Pad (Facsimile), 3 pages.

* cited by examiner

Fig. 2a
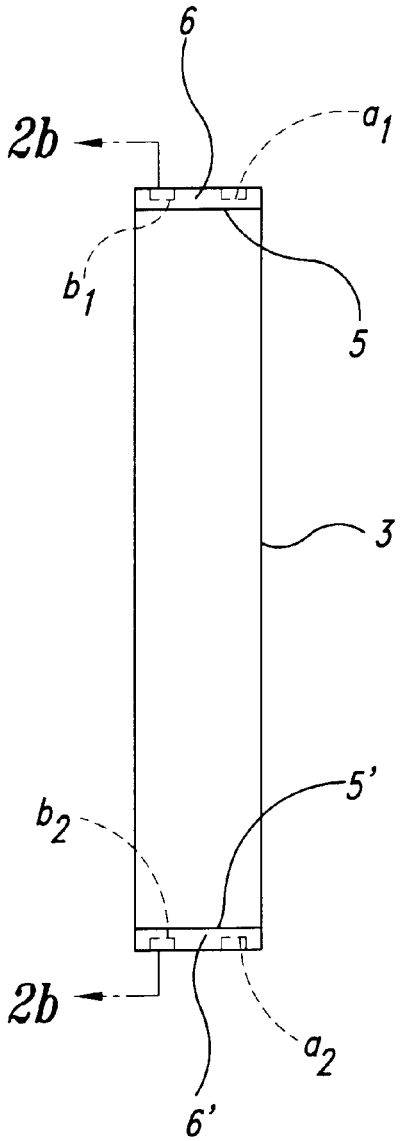
Fig. 2b
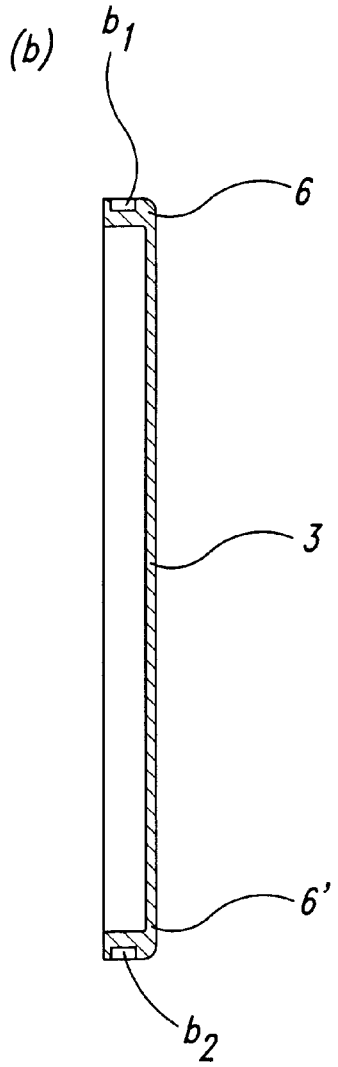
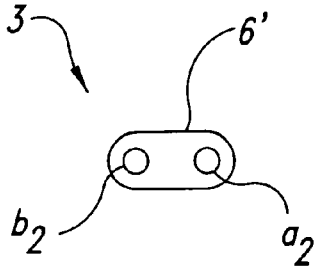
Fig. 2c

STAMP PAD WITH ROTARY LID AND ARTICULATED HINGE

CROSS-REFERENCE TO RELATED APPLICATION

This application claims priority to Japanese Patent Application 11-180637, filed Jun. 25, 1999.

Technical Field

This invention concerns a stamp pad with a rotatory lid and the manufacturing method thereof.

Background of the Invention

Traditionally, stamp pads are widely used for rubber stamp affixation. A stamp pad has an ink storage body and a pad base and is known to have various shapes and sizes.

Some of such stamp pads have lids removable from main bodies. FIG. 8 shows a schematic cross-sectional view of an example of traditional stamp pads. FIG. 9 is a schematic view of such a stamp pad with its lid opened. As shown in the figure, the traditional stamp pad consists of pad base 21 which has a concave surface 22, with such concave surface 22 having an ink storage body 23 which is made of ink-absorbing material, such as sponge and cloth, into which ink is absorbed, with the top portion 29 of such ink storage body 23 permanently stored on the pad base 21 in the manner that the former somewhat protrudes from the latter, forming the main body 20. The ink storage body 23 is covered from above by the lid 24, with the periphery of the pad base 21 having a groove 25 engraved thereon, whereby the tip of the periphery of the lid 24 is engageable with the engraved groove 25 in a freely engaging and disengaging manner for the purpose of placing and removing the lid.

In affixing a rubber stamp using such a stamp pad, the lid 24 is removed from the main body 20, the rubber stamp is pressed lightly on the ink storage body 23 of the stamp pad to apply ink on the stamp, and the stamp is affixed on paper and other applicable materials.

Some of the traditional stamp pads are known to have the structure which connects the main body and the lid with a hinge. FIG. 10 shows a schematic cross-sectional view of an example of traditional stamp pads with hinges. As shown in the figure, the ink storage body 33 made of ink-absorbing material, such as felt or sponge, with ink absorbed in it, is seated in the pad base 31, forming the main body 30. The ink storage body 33 is covered from above by the lid 34 and the lid 34 and the main body 30 are connected to each other with the hinge 31 in a freely rotatory manner for the purpose of placing the lid.

A stamp pad with a removable lid as shown in FIG. 9 requires a place to set the lid 24 when it is removed from the main body 20 as a rubber stamp is pressed on the ink storage body 23 of the stamp pad for ink application and stamp affixation.

Similarly, in the case of a stamp pad with the main body and the lid connected to each other with a hinge as shown in FIG. 10, the lid 34 occupies space when it is separated from the main body 30 and rotated 180 degrees to open it as a rubber stamp is pressed on the ink storage body 33 of the stamp pad for ink application and stamp affixation.

For these reasons, traditional stamp pads need a place to set the lids for stamp affixation. Moreover, the removable lids can be lost.

SUMMARY OF THE INVENTION

This invention is made to improve such shortcomings of the prior art as described above and is intended to provide a stamp pad with a rotatory lid and the manufacturing method thereof which eliminates the need for a place to set the lid by way of connecting a hinge plate to the main body and the rotatory lid in a freely rotatory manner and by way of rotating one full rotation the rotatory lid separated from the main body and storing the same underneath the main body, in which the hinge plate connected to the main body and the rotatory lid does not slip off easily and in which the hinge plate is easily connectable with the main body and the rotatory lid while the shape of the hinge plate is being changed.

BRIEF DESCRIPTION OF THE DRAWINGS

FIG. 2*a* is a front view of a U-shaped hinge plate of the stamp pad shown in FIGS. 1*a*–1*b*.

FIG. 2*b* is a cross-sectional view of the hinge plate shown in FIG. 2*a* taken substantially along line b–b'.

FIG. 2*c* is an end view of the hinge plate shown in FIG. 2*a*.

DETAILED DESCRIPTION OF THE INVENTION

Figure 1A:
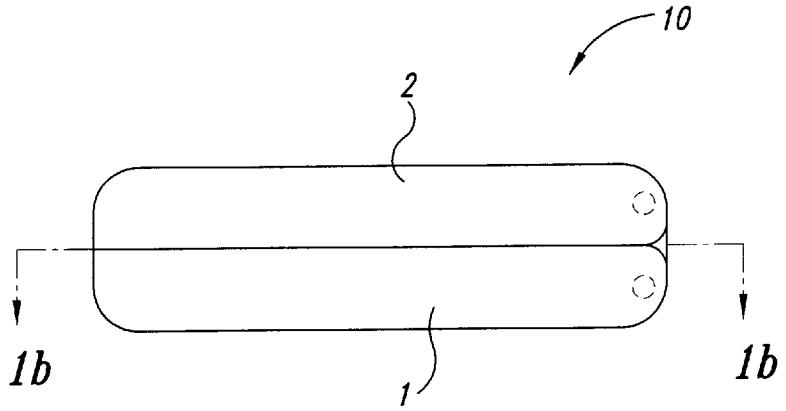
FIG. 1*a* is a side elevation view showing an example of a stamp pad with a rotatory lid in accordance with an embodiment of the present invention.

This invention concerns a stamp pad with a rotatory lid characteristic of having the main body which has two protrusions made on one side thereof at certain intervals and which has an ink pad with ink absorbed therein, a rotatory lid which has two protrusions made on one side thereof at certain intervals and which covers said ink pad and a hinge plate which has projections on both of the facing sides of a flat, quadrangular-shaped plate and which has two fitting grooves made on each of such projections, with such fitting grooves being connectable with the protrusions made on the main body and on the rotatory lid in a freely rotatory manner, whereby the hinge plate and the rotatory lid rotate while said fitting grooves and said protrusions maintain the connected state and the top side of said rotatory lid contacts the bottom side of the main body, resulting in the main body seated on top of said rotatory lid.

This invention also concerns a stamp pad with a rotatory lid characteristic of having the main body which has two fitting grooves made on one side thereof at certain intervals and which has an ink pad with ink absorbed therein, a rotatory lid which has two fitting grooves made on one side thereof at certain intervals and which covers said ink pad and a hinge plate which has projections on both of the facing sides of a flat, quadrangular-shaped plate and which has two protrusions on each of such projections, with such protrusions being connectable with the fitting grooves made on the main body and on the rotatory lid in a freely rotatory manner, whereby the hinge plate and the rotatory lid rotate while said protrusions and said fitting grooves maintain the connected state and the top side of said rotatory lid contacts the bottom side of the main body, resulting in the main body seated on top of said rotatory lid.

In one embodiment, the aforesaid hinge plate has projections on both of the facing shorter sides of a rectangular plate, with said projections having two fitting grooves each, and with said fitting grooves being connectable with the protrusions made on the main body and the rotatory lid in a freely rotatory manner, and having a U-shape.

Alternatively, the aforesaid hinge plate has projections on both of the facing sides of a quadrangular plate, with said projections having two fitting grooves each, with said fitting grooves being connectable with the protrusions made on the main body and on the rotatory lid in a freely rotatory manner, and having a U-shape.

In another embodiment, the aforesaid hinge plate has projections on both of the facing shorter sides of a rectangular plate, said projections having a T-shape, with said projections having two fitting grooves each, and with said fitting grooves being connectable with the protrusions made on the main body and on the rotatory lid in a freely rotatory manner, and having a T-shape.

Alternatively, the aforesaid hinge plate has projections on both of the facing sides of a quadrangular plate, said projections having a T-shape, with said projections having two fitting grooves each, and with said fitting grooves being connectable with the protrusions made on the main body and on the rotatory lid in a freely rotatory manner, and having a T-shape.

In one embodiment, the shape of the aforesaid hinge plate is changeable. For example, the aforesaid hinge can be made of thermoplastic resin.

In still another embodiment, the aforesaid rotatory lid separates from the main body and rotates 360 degrees, and the U-shaped hinge plate rotates 180 degrees, and the top side of the rotatory lid contacts the bottom side of the main body.

This invention also concerns the manufacturing method of a stamp pad with a rotatory lid. For example, in one embodiment, the method can include first stacking together the main body and the rotatory lid, the former of which has two protrusions made on one side thereof at certain intervals and which has an ink pad with ink absorbed therein, and the latter of which has two protrusions made on one side thereof at certain intervals and which covers said ink pad. After aligning a hinge plate, which has projections on both of the facing sides of a flat quadrangular-shaped plate with each of such projections having two fitting grooves, with the side of the main body and of the rotatory lid in such a manner that each of said protrusions corresponds to each of said fitting grooves, each such fitting groove is then connected with each such projection in a freely rotatory manner while the shape of the hinge plate is being changed.

In one aspect of this embodiment, the neighborhoods of both of the sides of the aforesaid hinge plate are pushed simultaneously to change the shape of the hinge plate while each of the fitting grooves and each of the protrusions are being connected with each other.

In another embodiment, the two fitting grooves on the projection on one side of the aforesaid hinge plate are first connected with one protrusion made on the aforesaid main body and on the aforesaid rotatory lid, and while the shape of the hinge plate is being changed outward, the two fitting grooves on the projection on the other side of the aforesaid hinge plate are then connected with the other protrusion made on the aforesaid main body and on the aforesaid rotatory lid.

The stamp pad with the rotatory lid of the present invention can have a hinge plate which becomes connected with the main body and the rotatory lid, the former of which has two protrusions made on one side thereof at certain intervals and which has an ink pad with ink absorbed therein, and the latter of which has two protrusions made on one side thereof at certain intervals and which covers said ink pad, by way of fitting each of such two protrusions to the respective fitting grooves made on the hinge plate.

For the hinge plate, a U-shaped hinge plate having fitting grooves made on the projections made on both of the facing sides of a flat, rectangular or quadrangular plate on a T-shaped hinge plate having fitting grooves made on the T-shaped projections made on both of the facing shorter sides of a flat, rectangular plate, among others, are used, and these hinge plates are so configured as to change their shapes at the time of connection, and once the connection is established, the protrusions and the fitting grooves resist slipping out of engagement with each other.

For example, the stamp pad with the rotatory lid of the present invention which uses a U-shaped hinge plate is characteristic of having the main body which has two protrusions made on one side thereof at certain intervals and which has an ink pad with ink absorbed therein, a rotatory lid which has two protrusions made on one side at certain intervals and which covers said ink pad and a U-shaped hinge plate which has projections on both of the facing shorter sides of a flat, rectangular plate and which has two fitting grooves on each of such projections, with such fitting grooves being connectable with the protrusions made on the main body and on the rotatory lid in a freely rotatory manner, whereby the U-shaped hinge plate and the rotatory lid rotate while said fitting grooves and said protrusions maintain the connected state and the top side of said rotatory lid contacts the bottom hinge of the main body, resulting in the main body seated on top of said rotatory lid.

The manufacturing method of the afore-described stamp pad with the rotatory lid which uses a U-shaped hinge plate of the present invention can include first stacking together the main body and the rotatory lid, the former of which has two protrusions made on one side thereof at certain intervals and which has an ink pad with ink absorbed therein, and the latter of which has two protrusions made on one side thereof at certain intervals and which covers said ink pad, for alignment purposes of the locations of the protrusions, and then of connecting in a freely rotatory manner the four fitting grooves made on the projections made on the edges of the shorter sides of the U-shaped hinge plate which has four fitting grooves corresponding to said protrusions with the protrusions made on said main body and on said rotatory lid while the shape of the longer sides of the rectangular U-shaped hinge plate is being changed outward, thereby unifying the main body and the rotatory lid and the hinge plate into one unit.

In the present invention, the aforesaid protrusions and fitting grooves used to connect together said main body and said rotatory lid and said U-shaped or T-shaped hinge plate can be reversed in positions, i.e., fitting grooves can be used in lieu of protrusions and protrusions can be used in lieu of fitting grooves.

EXAMPLES

Examples of embodiments of the present invention are explained below based on the figures given below.

Example 1

Examples of the stamp pad with the rotatory lid of the present invention using a U-shaped rectangular hinge plate are described below based on FIG. 1 through FIG. 5.

Figure 1B:
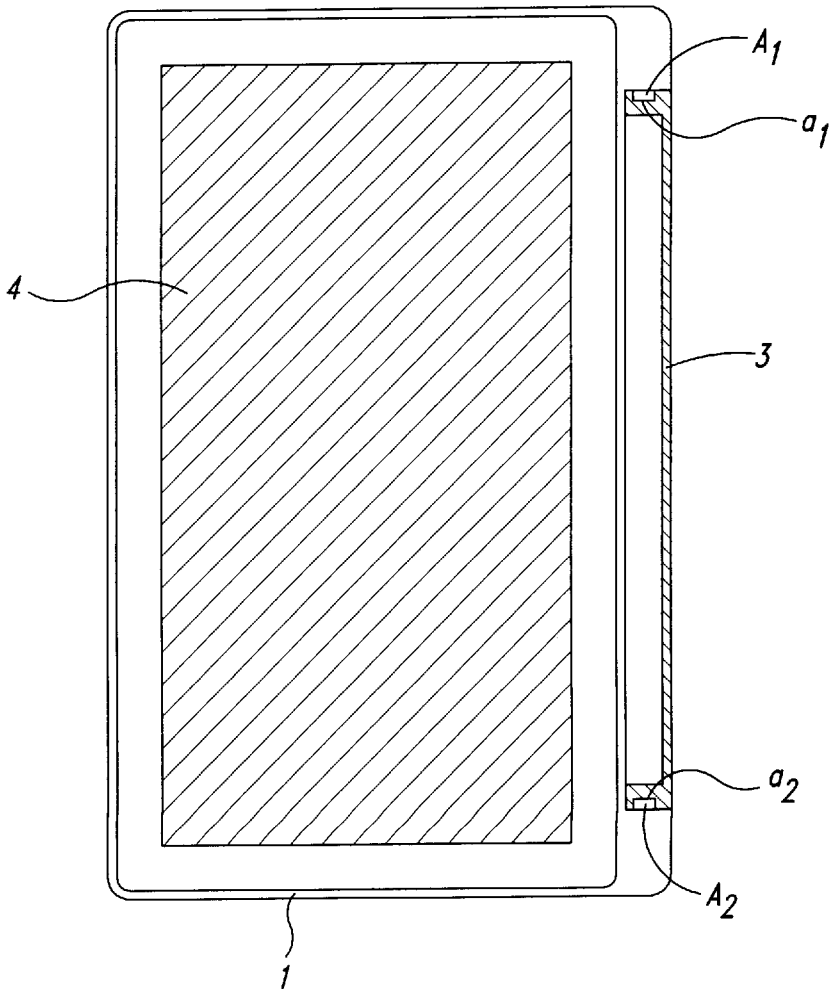
FIG. 1*b* is a cross-sectional view of the stamp pad container of FIG. 1*a* taken substantially along line a–a'.

FIGS. 1*a*–1*b* show an example of the stamp pad with the rotatory lid of the present invention. FIG. 1*a* is a side elevation view and FIG. 1*b* is a cross-sectional view of the main body when cut with the line a–a'. FIG. 2*a* is a front view of a U-shaped hinge plate, FIG. 2*b* is a schematic cross-sectional view of the U-shaped hinge plate when cut with the line b–b' and FIG. 2*c* is an end view of the U-shaped hinge plate.

Figure 3A:
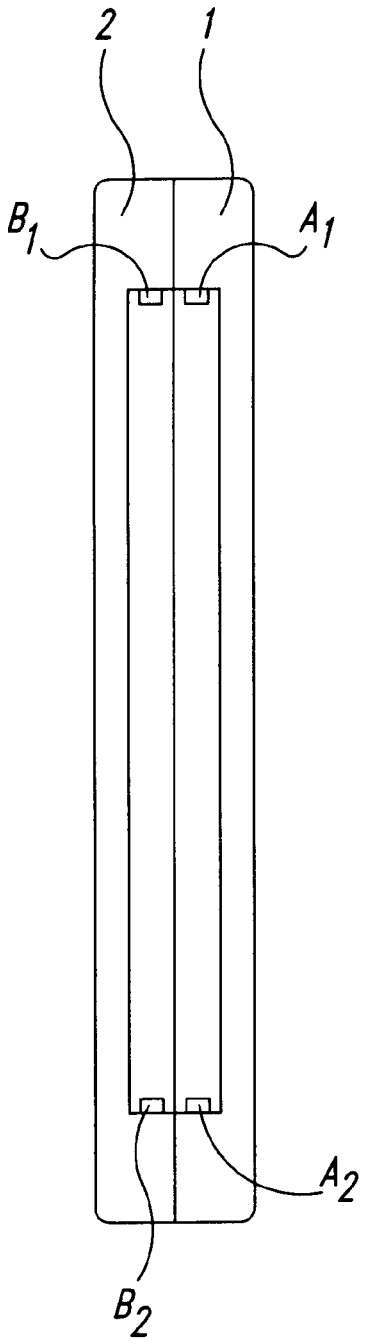
FIG. 3*a* is a rear view of the stamp pad shown in FIGS. 1*a*–1*b*.
Figure 3B:
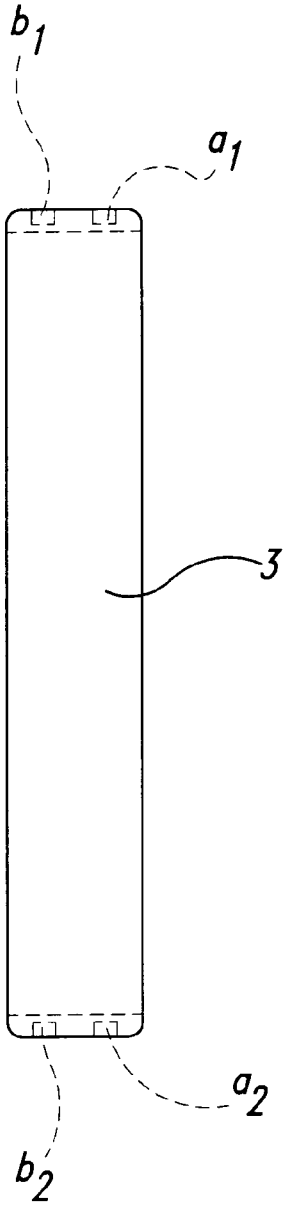
FIG. 3*b* is a rear view of the hinge plate shown in FIG. 2*a*.

FIGS. 3*a* and 3*b* show rear views of the stamp pad and the U-shaped hinge plate, respectively.

As shown in FIGS. 1*a*–1*b,* the stamp pad with the rotatory lid of the present invention 10 has main body 1, rotatory lid 2 and U-shaped hinge plate 3. The main body 1 has an ink pad 4 with ink absorbed therein and has rotatory lid 2 which covers said ink pad 4 and is freely separable from the main body.

The main body 1 has two protrusions $A_1$ and $A_2$ made on one side thereof at certain intervals and ink pad 4 with ink absorbed therein.

As shown in FIGS. 3*a*–3*b,* the rotatory lid has two protrusions $B_1$ and $B_2$ made on one side thereof at certain intervals at the locations which correspond to the protrusions $A_1$ and $A_2$ on the main body.

As shown in FIGS. 2*a*–2*c,* the U-shaped hinge plate 3 has projections 6 and 6' on the facing shorter sides of a rectangular-shaped plate, and the projection 6 has two fitting grooves $a_1$ and $b_1$ made thereon, and the projection 6' has two fitting grooves $a_2$ and $b_2$ made thereon. Said fitting grooves $a_1$ and $a_2$ are made at the locations which correspond to the protrusions $A_1$ and $A_2$ on the main body 1, and the fitting grooves $b_1$ and $b_2$ are made at the locations which correspond to the protrusions $B_1$ and $B_2$ on the rotatory lid, and these protrusions and fitting grooves fit each other in a freely rotatory manner.

Figure 4A:
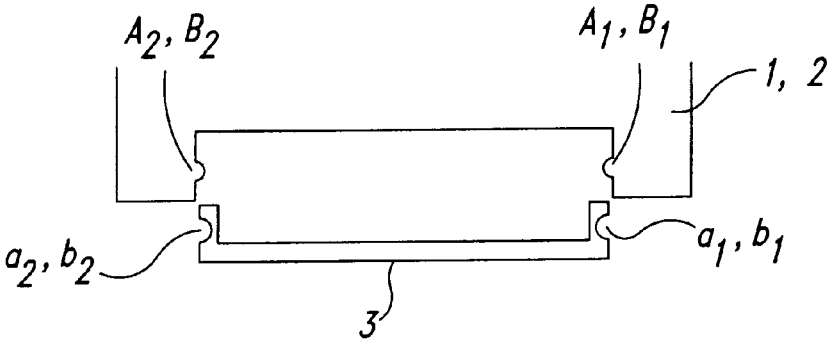
FIGS. 4*a*–4*c* show steps of a manufacturing method of the stamp pad with the rotatory lid in accordance with an embodiment of the present invention.
Figure 4B:
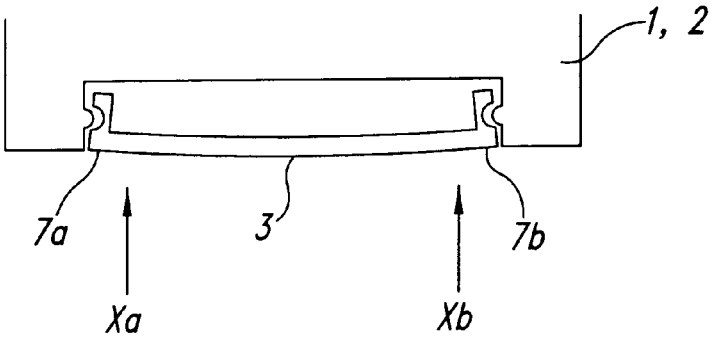
Figure 4C:
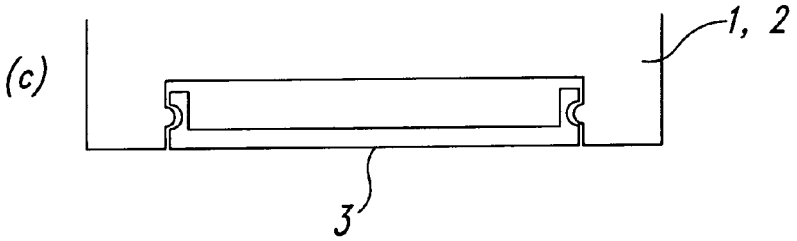

FIGS. 4*a*–4*c* show a manufacturing method, and a connecting method in particular, of the stamp pad with the rotatory lid in accordance with an embodiment of the present invention.

In one embodiment, the manufacturing method of the stamp pad with the rotatory lid requires that the main body 1 and the rotatory lid 2 be first stacked together for the alignment purpose of the locations of the aforesaid protrusions, the former of which has two protrusions $A_1$ and $A_2$ on one side thereof and the latter of which has two protrusions $B_1$ and $B_2$ on one side thereof, and that the U-shaped hinge plate 3 is then aligned with the sides of the main body 1 and the rotatory lid 2 in such a manner that the fitting grooves $a_1$ and $a_2$ on the U-shaped hinge plate 3 correspond to the protrusions $A_1$ and $A_2$ on the main body 1 and that the fitting grooves $b_1$ and $b_2$ on the U-shaped hinge plate correspond to the protrusions $B_1$ and $B_2$ on the rotatory lid (FIG. 4*a*). Next, simultaneously pushing with two fingers both ends 7*a* and 7*b* of the U-shaped hinge plate 3 in the direction of the arrows Xa and Xb respectively (FIG. 4*b*) causes the U-shaped hinge plate 3 to change its shape to a bow shape, resulting in the connection between each of the aforesaid protrusions and each of the aforesaid fitting grooves, thereby unifying the main body and the rotatory lid into one unit in a freely rotatory manner (FIG. 4*c*).

Additionally, another engagement method in the manufacturing method of the stamp pad with the rotatory lid of the present invention is that the two fitting grooves $a_1$ and $b_1$ on the projection on one shorter side of the U-shaped hinge plate 3 are first connected with the protrusions $A_1$ and $B_1$ of the main body 1 and of the rotatory lid respectively and, while the shape of the U-shaped hinge plate 3 is being changed outward, the two fitting grooves $a_2$ and $b_2$ on the projections on the other shorter side of the U-shaped hinge plate are then connected with the other protrusions $A_2$ and $B_2$ on the main body and of the rotatory lid respectively, thereby unifying the main body and the rotatory lid into one unit in a freely rotatory manner.

Figure 5A:
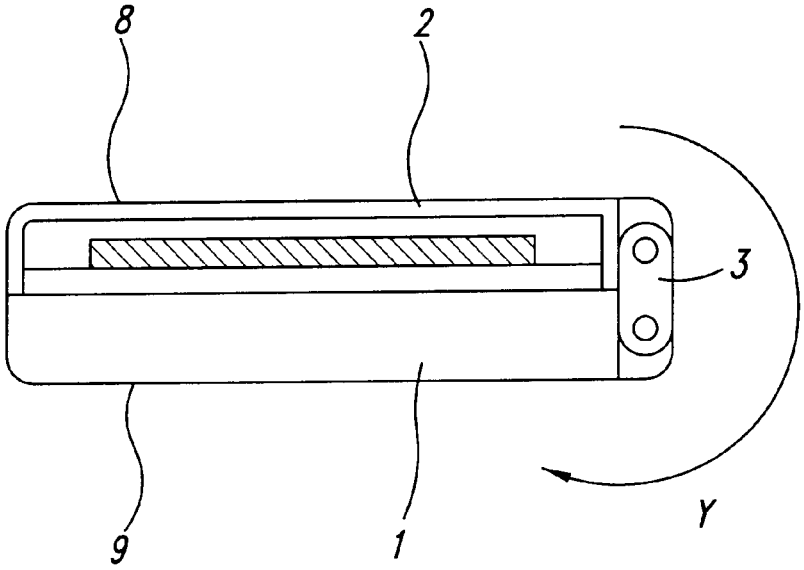
FIG. 5*a* is a side elevation view of a stamp pad in a closed position in accordance with an embodiment of the invention.
Figure 5B:
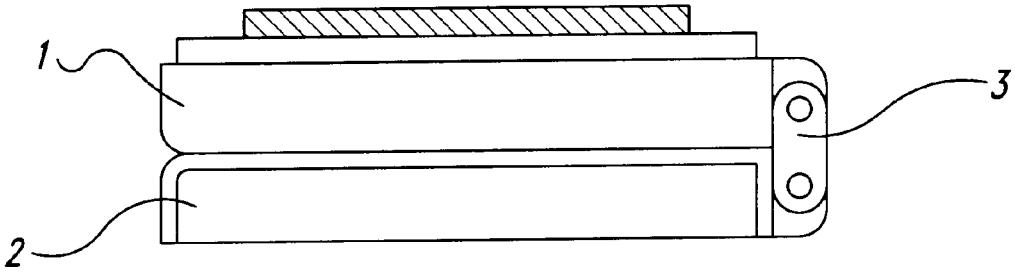
FIG. 5*b* is a side elevation view of the stamp pad of FIG. 5*a* in an open position.

FIGS. 5*a*–5*b* show the opened and closed positions of the stamp pad with the rotatory lid of the present invention, with FIG. 5*a* showing the closed position and FIG. 5*b* showing the opened position. As shown in FIGS. 5*a*–5*b,* the stamp pad with the rotatory lid of the present invention has the effect that when the rotatory lid 2 is separated from the main body 1 (while remaining coupled via the U-shaped hinge plate 3) and is rotated in the Y direction, the U-shaped hinge plate 3 and the rotatory lid 2 rotate while the protrusions and the fitting grooves maintain the connected status, and that the top side 8 of the rotatory lid 2 contacts the bottom side 9 of the main body and the main body is seated on top of the rotatory lid, i.e., the rotatory lid 2 becomes separated from the main body and rotates 360 degrees and the U-shaped hinge plate rotates 180 degrees, fully opening the rotatory lid, with the top side 8 of the rotatory lid contacting the bottom side 9 of the main body 1, and the rotatory lid 2 becoming up side down and being placed underneath the main body serving as the basis thereof.

In the present invention, there is no particular restriction on the materials to be used for the main body or the rotatory lid. In one embodiment, however, they are made of resin, and thermoplastic resin, in particular.

In one embodiment, the U-shaped hinge plate in the present invention has projections on both of the facing shorter sides of a flat rectangular-shaped plate, made of any material so long as it allows the longer sides of the plate to change its shape when the projections and the fitting grooves are connected together, but desirably, the plate is made of thermoplastic resin, for example, such as styrene resin and ABS resin, among others.

Example 2

An embodiment example of the stamp pad with the rotatory lid of the present invention using a T-shaped hinge plate is described below based on FIG. 6.

Figure 6A:
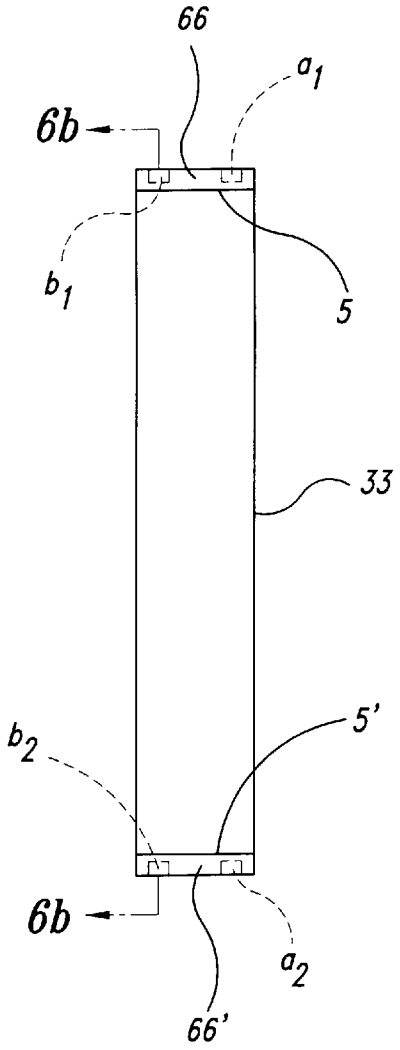
FIG. 6*a* is a front elevation view of a hinge plate having a T-shape in accordance with an embodiment of the invention.
Figure 6B:
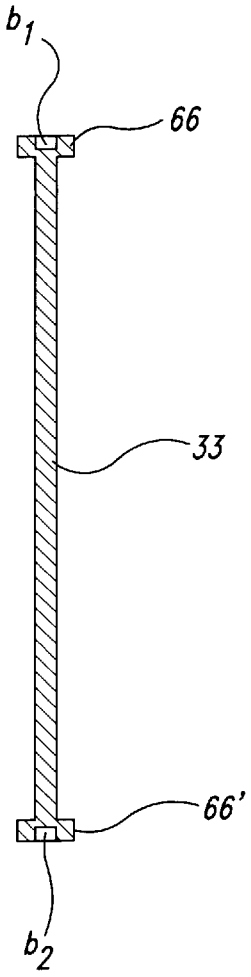
FIG. 6*b* is a cross-sectional view of the hinge plate of FIG. 6*a* taken substantially along line c–c'.
Figure 6C:
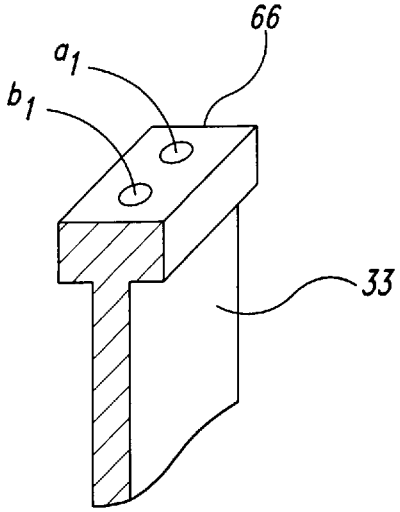
FIG. 6*c* is a bottom isometric view of a portion of the hinge plate shown in FIGS. 6*a*–6*b*.

FIGS. 6*a*–6*b* show an example of the T-shaped hinge plate. FIG. 6*a* is the front view, FIG. 6*b* is the cross-sectional view when cut with line c–c' and FIG. 6*c* shows an oblique view of an enlarged area of the T-shaped hinge plate.

As shown in FIGS. 6*a*–6*b*, the T-shaped hinge plate 33 has T-shaped projections 66 and 66' on the facing shorter sides 5 and 5' of the flat, rectangular plate, and said projection 66 has two fitting grooves $a_1$ and $b_1$ made thereon, and said projection 66' has two fitting grooves $a_2$ and $b_2$ made thereon. Said fitting grooves $a_1$ and $a_2$ are located in the positions which correspond to the protrusions $A_1$ and $A_2$ on the main body 1 respectively, and said fitting grooves $b_1$ and $b_2$ are located in the positions which correspond to the protrusions $B_1$ and $B_2$ on the rotatory lid respectively, and these protrusions and fitting grooves fit each other in a freely rotatory manner.

Except for the use of the aforesaid T-shaped hinge plate 33, the manufacturing method of the stamp pad with the rotatory lid was the same as described in Example 1. In manufacturing the stamp pad with the rotatory lid, the protrusions made on the main body and on the rotatory lid were able to be connected in a freely rotatory manner, with the four fitting grooves on the projections at the ends of the T-shaped hinge plate while the shape of the longer sides of the T-shaped hinge plate was being changed outward.

Example 3

An embodiment example of the stamp pad with the rotatory lid of the present invention using a quadrangular U-shaped hinge plate is described below based on FIGS. 7*a*–7*c*.

Figure 7A:
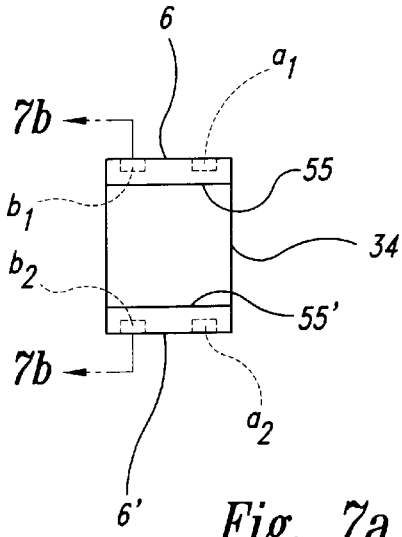
FIG. 7*a* is a front elevation view of a U-shaped hinge plate in accordance with another embodiment of the invention.
Figure 7B:
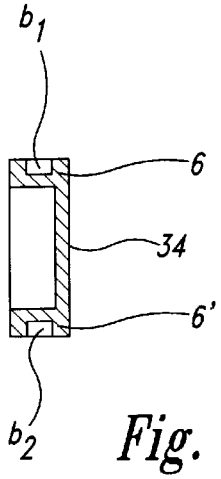
FIG. 7*b* is a cross-sectional view of the hinge plate shown in FIG. 7*a* taken substantially along line d–d'.
Figure 7C:
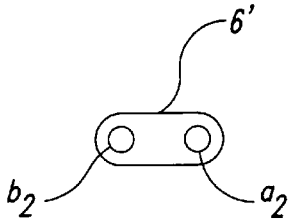
FIG. 7*c* is an end view of the hinge plate shown in FIGS. 7*a*–7*b*.
Figure 8:
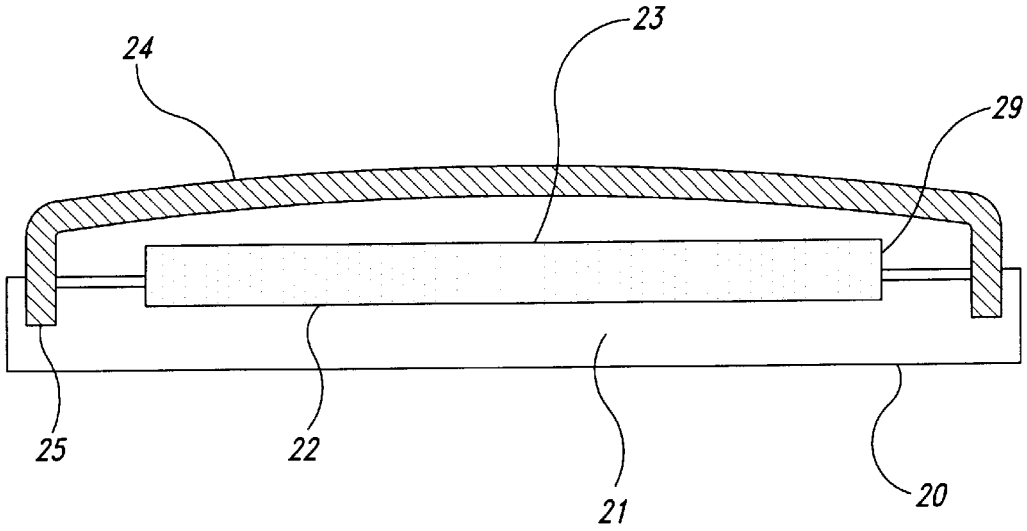
Fig. 8 (Prior Art)
FIG. 8 is a schematic cross–sectional view of an example of traditional stamp pad.
Figure 9:
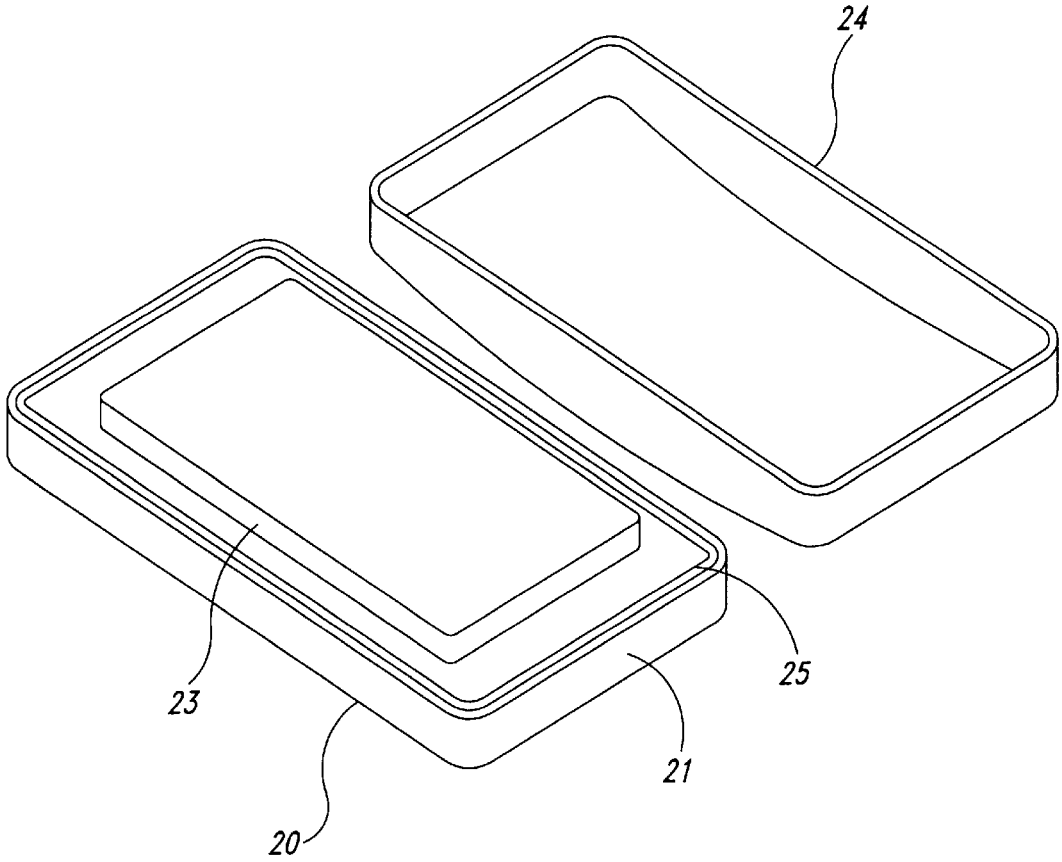
Fig. 9 (Prior Art)
FIG. 9 is a schematic showing the opened position of the traditional stamp pad in FIG. 8.
Figure 10:
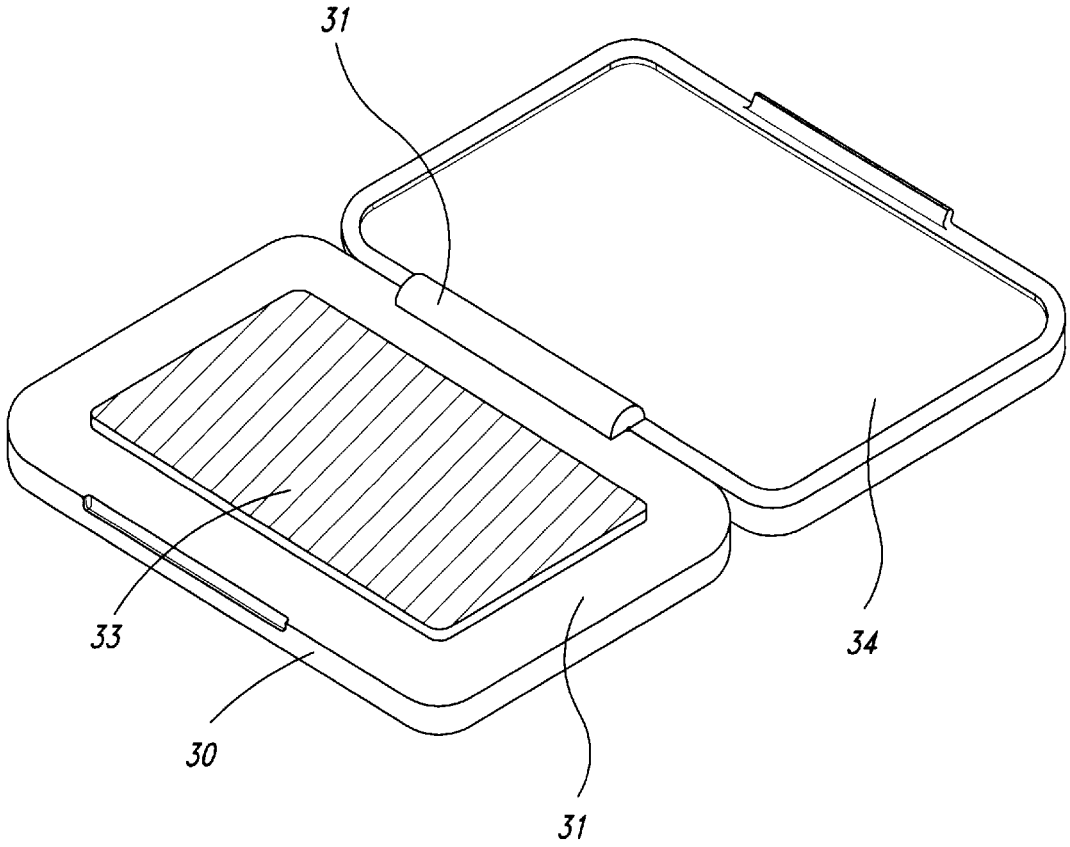
Fig. 10 (Prior Art)
FIG. 10 is a schematic cross-sectional view of an example of traditional stamp pads with hinges.

FIGS. 7*a*–7*c* show an example of the quadrangular, U-shaped hinge plate. FIG. 7*a* is the front view, FIG. 7*b* is the cross-sectional view when cut with line d–d' and FIG. 7*c* shows the bottom view of the quadrangular, U-shaped hinge plate.

As shown in FIG. 7, the quadrangular, U-shaped hinge plate 34 has projections 6 and 6' on the facing shorter sides 55 and 55' of the flat, quadrangular plate, with said projection 6 having two fitting grooves $a_1$ and $b_1$ made thereon, and said projection 6' having two fitting grooves $a_2$ and $b_2$ made thereon. Said fitting grooves $a_1$ and $a_2$ are located in the positions which correspond to the protrusions $A_1$ and $A_2$ on the main body 1 respectively, and said fitting grooves $b_1$ and $b_2$ are located in the positions which correspond to the protrusions $B_1$ and $B_2$ on the rotatory lid respectively, and these protrusions and fitting grooves fit each other in a freely rotatory manner.

Except for the use of the aforesaid U-shaped hinge plate 34, the manufacturing method the stamp pad with the rotatory lid was the same as described in Example 1. In manufacturing the stamp pad with the rotatory lid, the protrusions made on the main body and on the rotatory lid were able to be connected, in a freely rotatory manner, with the four fitting grooves on the projections at the ends of the U-shaped hinge plate while the shape of the sides, which do not have projections made thereon, of the U-shaped hinge plate was being changed outward.

The U-shaped hinge plate 34 shown in the Example 3 is used particularly for a small-sized, thick stamp pad with a rotatory lid.

In the present invention, the aforesaid protrusions and fitting grooves used to connect said main body and said rotatory lid and said U-shaped or T-shaped hinge plate, described in Examples 1 through 3, can be reversed in positions, i.e., fitting grooves can be used in lieu of protrusions and protrusions can be used in lieu of fitting grooves.

The present invention, the U-shaped hinge plate or the T-shaped hinge plate is so shaped as to have projections on the facing shorter sides or the facing sides of a flat, rectangular or a quadrangular plate, and because the longer sides or the sides thereof are shape-changeable, the U-shaped hinge plate or the T-shaped hinge plate changes its shape to a bow shape when the U-shaped hinge plate or the T-shaped hinge plate is connected with the main body and the rotatory lid, thereby allowing easy connection between the fitting grooves and the protrusions, resulting in easy unification of the rotatory lid and the main body into one unit.

Moreover, because the U-shaped hinge plate or the T-shaped hinge plate is shape-changeable as to the longer sides thereof at the time of connection, allowing the maximum approach position thereof to the interval between the two protrusions made on the main body and on the rotatory lid, the U-shaped hinge plate or the T-shaped hinge plate will not slip away or be dislocated from the main body and the rotatory lid after the connection is established.

An advantage of an embodiment of the stamp pad with a rotatory lid discussed above with reference to FIGS. 1–7 is that it successfully eliminates the need for a place to set the rotatory lid aside for stamp affixation because the main body and the rotatory lid are connected to each other with the U-shaped hinge plate or the T-shaped hinge plate in a freely rotatory manner, which allows the rotatory lid when separated from the main body to be rotated one full rotation and stored underneath the bottom of the main body, in which the U-shaped hinge plate or the T-shaped hinge plate connected with the main body and the rotatory lid does not easily slip away and in which the main body and the rotatory lid can be easily connected with each other by way of the U-shaped hinge plate or the T-shape hinge plate.

What is claimed is:

1. A stamp pad comprising:

a main body which has one of at least one protrusion and at least one groove on one side thereof, and which has an ink pad configured to absorb ink therein;

a rotary lid which has one of at least one protrusion and at least one groove on one side thereof, and which covers said ink pad; and a hinge plate which has projections on opposing sides thereof; and which has the other of at least one protrusion and at least one groove on each of such projections, with the hinge plate being rotatably connected to the main body and the rotary lid whereby the hinge plate and the rotary lid can rotate with respect to the main body while the grooves and protrusions maintain connected, and a top side of the rotary lid can contact a bottom side of the main body, resulting in the main body seated on top of the rotary lid.

2. A stamp pad comprising:

a main body which has one of two protrusions and two grooves spaced apart from each other on one side thereof, and which has an ink pad configured to absorb ink therein;

a rotary lid which has one of two protrusions and two grooves spaced apart from each other on one side thereof, and which covers said ink pad; and a hinge plate which has projections on opposing sides thereof, and which has the other of two protrusions and two grooves, one on each of the projections, with the hinge plate being connected to the main body and the rotary lid in a freely rotatable manner, whereby the hinge plate and the rotary lid can rotate with respect to the main body while maintaining connected, and a top side of the rotary lid can contact a bottom side of the main body, resulting in the main body seated on top of the rotary lid.

3. The stamp pad of claim 1 or 2 wherein the projections on the opposing sides of the hinge plate are substantially rectangular, with each of the projections having one of two protrusions and two grooves connectable with the complementary grooves or protrusions on the main body and the rotary lid, and the hinge plate having a U-shape.

4. The stamp pad of claim 1 or 2 wherein the projections on the opposing sides of the hinge are substantially T-shaped, with each of said projections having one of two protrusions and two grooves being connectable with the complementary grooves or protrusions on the main body and the rotary lid, and the hinge plate having a T-shape.

5. The stamp pad of claim 1 or 2 wherein the shape of the hinge plate is changeable.

6. The stamp pad of claim 1 or 2 wherein the hinge plate comprises a thermoplastic resin.

7. The stamp pad of claim 1 or 2 wherein the rotary lid is removable from said main body and rotatable 360 degrees with respect to the main body, with the hinge plate rotatable 180 degrees with respect to the main body to a fully opened position wherein a top side of the rotary lid contacts a bottom side of the main body.

8. A method for making a stamp pad comprising:

stacking together a main body and a rotary lid, the main body having one of two grooves and two protrusions spaced apart from each other on one side thereof, and which has an ink pad with ink absorbed therein, and the rotary lid having one of two grooves and two protrusions spaced apart from each other on one side thereof, and which covers said ink pad, and engaging a hinge plate with opposing sides each having the other of two grooves and two projections with the one side of the main body and the one side of the rotary lid such that each of the protrusions corresponds to one of the grooves, and the rotary lid is rotatably connected to the main body.

9. The method of claim 8 wherein engaging the hinge plate comprises pushing the opposing sides of the hinge plate to cause engagement between each of the grooves and the respective projections.

10. The method of claim 8 wherein engaging the hinge plate comprises first connecting the grooves or protrusions on a first side of the hinge plate with a complementary protrusion or groove on each of the main body and the rotary lid and then, while the orientation of the hinge plate is being changed, connecting the grooves or protrusions on a second side of the hinge plate with a complementary protrusion or groove on each of the main body and rotary lid.

* * * * *

UNITED STATES PATENT AND TRADEMARK OFFICE

CERTIFICATE OF CORRECTION

PATENT NO. : 6,199,482 B1
DATED : March 13, 2001
INVENTOR(S) : Rira Yasishima

It is certified that error appears in the above-identified patent and that said Letters Patent is hereby corrected as shown below:

Title page,
Item [56], References Cited, reference -- D 427,624 -- should be included.

Column 9, claim 4,
Lines 12 and 13, "sides of the hinge are substantially T-shaped, with" should read -- sides of the hinge plate are substantially T-shaped, with --.

Column 10, claim 8,
Line 8, "ink pad, and" should read -- ink pad; and --.

Signed and Sealed this

Nineteenth Day of February, 2002

*Attest:*

*Attesting Officer*

JAMES E. ROGAN
*Director of the United States Patent and Trademark Office*